US007370890B2

(12) United States Patent
Samsel

(10) Patent No.: US 7,370,890 B2
(45) **Date of Patent: *May 13, 2008**

(54) STORAGE CABINET WITH LOCKING SYSTEM HAVING DUAL RELEASE MEMBERS

(75) Inventor: Richard A. Samsel, Haines, FL (US)

(73) Assignee: Delta Consolidated Industries, Raleigh, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/765,404

(22) Filed: Jan. 26, 2004

(65) Prior Publication Data

US 2004/0194517 A1 Oct. 7, 2004

(51) Int. Cl.
*E05C 1/00* (2006.01)

(52) U.S. Cl. ..... 292/42; 292/8; 292/33; 292/302; 292/341.15; 292/162; 312/139

(58) Field of Classification Search ..... 312/215, 312/216, 217, 218, 220, 222, 351.3, 139; 292/DIG. 21, 137, 162–164, 167, 8, DIG. 6, 292/32–43, 300, 302, 341.15
See application file for complete search history.

(56) References Cited

U.S. PATENT DOCUMENTS 1,319,603 A * 10/1919 Monfet ..... 70/101
1,438,547 A 12/1922 O'Connor
1,511,725 A 1/1924 Hart
1,661,370 A * 3/1928 Kaser ..... 312/222
1,702,385 A * 2/1929 Kaser ..... 312/222
1,716,169 A * 6/1929 Hart ..... 312/217
1,774,783 A 9/1930 Worley, Jr. et al.

(Continued)

OTHER PUBLICATIONS

Knaack Jobsite Chests & Cabinet; *Grainger Catalog* (1987) pp. 481.

(Continued)

*Primary Examiner*—Jack W. Lavinder
(74) *Attorney, Agent, or Firm*—Myers Bigel Sibley & Sajovec

(57) ABSTRACT

A storage cabinet comprises: a container having a floor, upright side walls and a rear wall attached to and extending upwardly from the floor, and a ceiling attached to the side walls and rear wall, the floor, side walls, rear wall, and ceiling defining a storage cavity; a vertical support member extending upwardly from the floor; at least one door pivotally attached to one of the side walls and movable between an open position, in which the cavity is accessible from a position forward thereof, and a closed position, in which the door contacts the support member and prevents access to the cavity from a position forward thereof; and a latching mechanism attached to the support member. The latching mechanism includes two release members protruding forwardly from the support member, wherein an upper one of the release members is positioned above a lower one of the release members. The release members are movable in unison from a latched position, in which the latching mechanism latches the door in the closed position, and an unlatched position, in which the latching mechanism allows the door to move to the open position. In this configuration, an operator carrying a load with both hands can choose to unlatch the door by hand or by foot, depending on which method is more convenient.

4 Claims, 10 Drawing Sheets

U.S. PATENT DOCUMENTS

| | | | | | |
|---|---|---|---|---|---|
| 1,847,564 | A | * | 3/1932 | Hood | 292/255 |
| 1,955,525 | A | * | 4/1934 | Bales | 292/33 |
| 2,130,302 | A | | 9/1938 | Henderson | |
| 2,163,307 | A | | 6/1939 | Hart | |
| 2,188,703 | A | | 1/1940 | Burke | |
| 2,852,926 | A | | 9/1958 | Chervenka | |
| 3,004,420 | A | | 10/1961 | Pipe | |
| 3,601,437 | A | * | 8/1971 | Lyons | 292/256.5 |
| 3,722,236 | A | | 3/1973 | Zelenko | |
| 4,290,281 | A | | 9/1981 | Knaach et al. | |
| 4,383,721 | A | | 5/1983 | Knaack et al. | |
| 4,813,726 | A | * | 3/1989 | Ravinet | 292/241 |
| 5,048,902 | A | | 9/1991 | Daly | |
| 5,061,022 | A | * | 10/1991 | Meriwether | 312/324 |
| 5,076,078 | A | | 12/1991 | Weger, Jr. | |
| 5,622,416 | A | * | 4/1997 | Rainey et al. | 312/319.9 |
| 5,785,363 | A | * | 7/1998 | Stopfer et al. | 292/165 |
| 5,794,844 | A | * | 8/1998 | Jenkins | 232/25 |
| 6,224,118 | B1 | * | 5/2001 | Ashford | 292/202 |
| 6,422,612 | B1 | * | 7/2002 | Hays et al. | 292/5 |

OTHER PUBLICATIONS

Steel Chests and Cabinet; *Grainger Catalog* (1988) pp. 499.
Jobsite Chests and Cabinet; *Grainger Catalog* (1991) pp. 709.
Jobsite Chests and Cabinets; *Grainger Catalog* (1993) pp. 890.
Jobsite Chests and Cabinets; *Grainger Catalog* (1993) pp. 1013.
Jobsite Chests and Cabinets; *Grainger Catalog* (1993) pp. 1080.
Knaack Catalog (Jan. 1991).
Knaack Catalog (Jan. 19, 1998).

* cited by examiner

STORAGE CABINET WITH LOCKING SYSTEM HAVING DUAL RELEASE MEMBERS

FIELD OF THE INVENTION

The present invention is directed generally to storage cabinets, and more particularly to locking systems for storage cabinets.

BACKGROUND OF THE INVENTION

Large storage cabinets used in the construction industry are often formed of steel sheet. Such cabinets typically include opposed side walls, a rear wall, a floor, a ceiling, and one or two doors that are pivotally mounted on the front edges of the side walls to provide access to the cabinet from the front. The floor, walls and ceiling of the cabinet can be formed either from a single sheet of steel that is bent at intersecting edges of these surfaces or from multiple pieces of sheet steel that are welded together. Often, such a cabinet will also include one or more shelves which facilitate the storage of tools and other items. Also, many cabinets have bolsters underlying the floor, and some will include casters beneath the bolsters. The doors of the cabinet are typically formed of a single sheet of steel and, with the exception of narrow finishing flanges around the edges, they are relatively flat. Typical sizes for such a cabinet can range from 40 $ft^3$ to 60 $ft^3$ or even larger. Exemplary storage cabinets include those sold under the name JOBOX® by Delta Consolidated Industries, Jonesboro, Ark. and those sold under the name JOBMASTER® by Knaack Manufacturing, Crystal Lake, Ill.

As noted above, many storage cabinets of the type described above have doors pivotally attached to the front edges of the side walls to alternatively allow and prevent access to the cavity of the cabinet from the front. Generally such cabinets have a vertical support member that is mounted to and extends from the floor to the ceiling. The support member is positioned such that it spans the gap between the free edges of the doors when they are closed. Each door will typically have an engaging member of a latch (such as a hook) attached near its free edge that interacts with a latching mechanism attached to the support member. As an example, one latching mechanism includes horizontally-disposed pins that engage with hooks on the doors and thereby latch the doors in place. The pins are mounted on a vertical rod that is slidably mounted to the rear surface of the support member. The pins can be raised to unlatch the doors via a lever or knob that extends forwardly from the vertical rod through a vertical slot in the support member.

Many cabinets will also include a locking system that enables the doors to be locked in the latched position. One such locking system (illustrated in U.S. Pat. Nos. 4,290,281 and 5,076,078 to Weger, Jr.) includes a "pocket" located in the vertical support member that houses a padlock. The padlock is disposed horizontally within the pocket, with the "key insertion end" of the padlock body being exposed for forward access through the pocket, and the shackle of the padlock extending toward the cavity of the storage cabinet and being restrained by a bracket within the pocket. The body and shackle surround an upright notched member that is attached to and moves vertically with the latching mechanism. When the padlock is locked, the body engages the notch of the notched member, so vertical movement of the latching mechanism is prevented (i.e., the doors of the cabinet are locked and remain locked). When the padlock is unlocked, horizontal movement of the body away from the shackle creates sufficient space for the notched member to become disengaged from the body, and the latching mechanism is free to move vertically to unlatch the doors of the cabinet. This type of locking configuration is particularly desirable for storage cabinets used and left overnight at construction sites, as the pocket protects the lock from being destroyed by someone severing the shackle with a bolt cutter or a similar tool.

One difficulty with the latching and locking mechanisms of current storage cabinets is the inconvenience of opening the cabinet when an operator's hands are full. Even if the cabinet is unlocked and the latching mechanism is free to move, the operator is forced to reach with his hand to grasp and pull the latching lever. If many items are being carried, or if an item being carried is particularly heavy or bulky, the operator may be forced either to set down some or all of his load or to balance the load with one hand and arm in order to unlatch the doors of the cabinet.

Another performance issue of current latching systems presents itself when the operator wishes to close the doors. With the system described above, often the latching mechanism will remain in the unlatched position after unlatching, either simply by friction or through a subassembly designed for this purpose. An operator opens the doors by moving release lever to the unlatched position, at which time both doors would have the opportunity to open. Often, both doors tend to open; this is particularly true if the cabinet is positioned on uneven ground, with the front of the cabinet being lower than the rear of the cabinet. If the operator reaches in to gather items from within the cabinet and has his hands full, closing and latching the doors is difficult, because the latch remains in the unlatched position until actively moved back by the operator. A related problem occurs when the operator wishes to open only one door; with the latching mechanism in the unlatched position, the door that he wishes to remain closed will have a tendency to open unless he actively moves the release lever back to the locking position after opening the door he wishes to open.

Another shortening of the current cabinets is the tendency of the bolsters to fracture when casters are mounted thereunder. The bolsters are typically formed of a single sheet of steel bent into the shape of an open rectangular box. The cabinets are often loaded sufficiently that bolsters of this structure may have inadequate strength to support the load; as a result, the bolsters fail at the mounting locations of the casters.

SUMMARY OF THE INVENTION

The present invention can address the shortcomings of prior latching systems by enabling the operator to unlatch the doors by using either of an upper release member (which is positioned at a height convenient for operation by hand) or a lower release member (which is positioned at a height convenient for operation by foot). One embodiment of such a storage cabinet comprises: a container having a floor, upright side walls and a rear wall attached to and extending upwardly from the floor, and a ceiling attached to the side walls and rear wall, the floor, side walls, rear wall, and ceiling defining a storage cavity; a vertical support member extending upwardly from the floor; at least one door pivotally attached to one of the side walls and movable between an open position, in which the cavity is accessible from a position forward thereof, and a closed position, in which the door contacts the support member and prevents access to the cavity from a position forward thereof; and a latching mechanism attached to the support member. The latching mechanism includes two release members protruding forwardly from the support member, wherein an upper one of the release members is positioned above a lower one of the release members. The release members are movable in unison from a latched position, in which the latching mechanism latches the door in the closed position, and an unlatched position, in which the latching mechanism allows the door to move to the open position. In this configuration, an operator carrying a load with both hands can choose to unlatch the door by hand or by foot, depending on which method is more convenient.

A preferred embodiment of the storage cabinet includes two doors, each of which includes a front panel that is forwardly spaced from said support member, and the upper and lower release members are of a length such that they do not protrude forwardly beyond the front panels of the doors. This protects passers-by from snagging clothing on the release levers.

In another embodiment, a storage cavity of the present invention includes a container, a support member and at least one door as defined above, and further includes a latching mechanism having at least one release member protruding forwardly from the support member and being movable from a latched position, in which the latching mechanism latches the door in the closed position, and an unlatched position, in which the latching mechanism allows the door to move to the open position. The latching mechanism also includes a generally vertically disposed post that is slidably mounted on the support member for vertical movement relative thereto. The post is attached to the at least one release member. The latching mechanism further includes a biasing unit (for example, a spring) that biases the latching mechanism toward the latched position. This configuration enables the latching mechanism to move from the unlatched position to the latched position without the operator actively causing this action. This feature can assist in keeping one or more doors of the cabinet closed.

Another aspect of the present invention is a bolster assembly that can be used with storage cabinets of the type described above. Such a bolster assembly includes: a lower channel having a horizontally-disposed floor and opposed upright side walls; a front bracket having a horizontally-disposed floor and an upright front wall, wherein the front bracket floor is attached to and overlies a front portion of the lower channel floor; a rear bracket having a horizontally-disposed floor and an upright rear wall, wherein the rear bracket floor is attached to and overlies a rear portion of the lower channel floor; a front castor attached to and underlying the front portion of said lower channel; and a rear castor attached to and underlying the rear portion of said lower channel. A bolster assembly of this configuration can provides a reinforced mounting location for the casters that reduces the tendency of the bolster to fail under load.

DETAILED DESCRIPTION OF THE INVENTION

Figure 1:
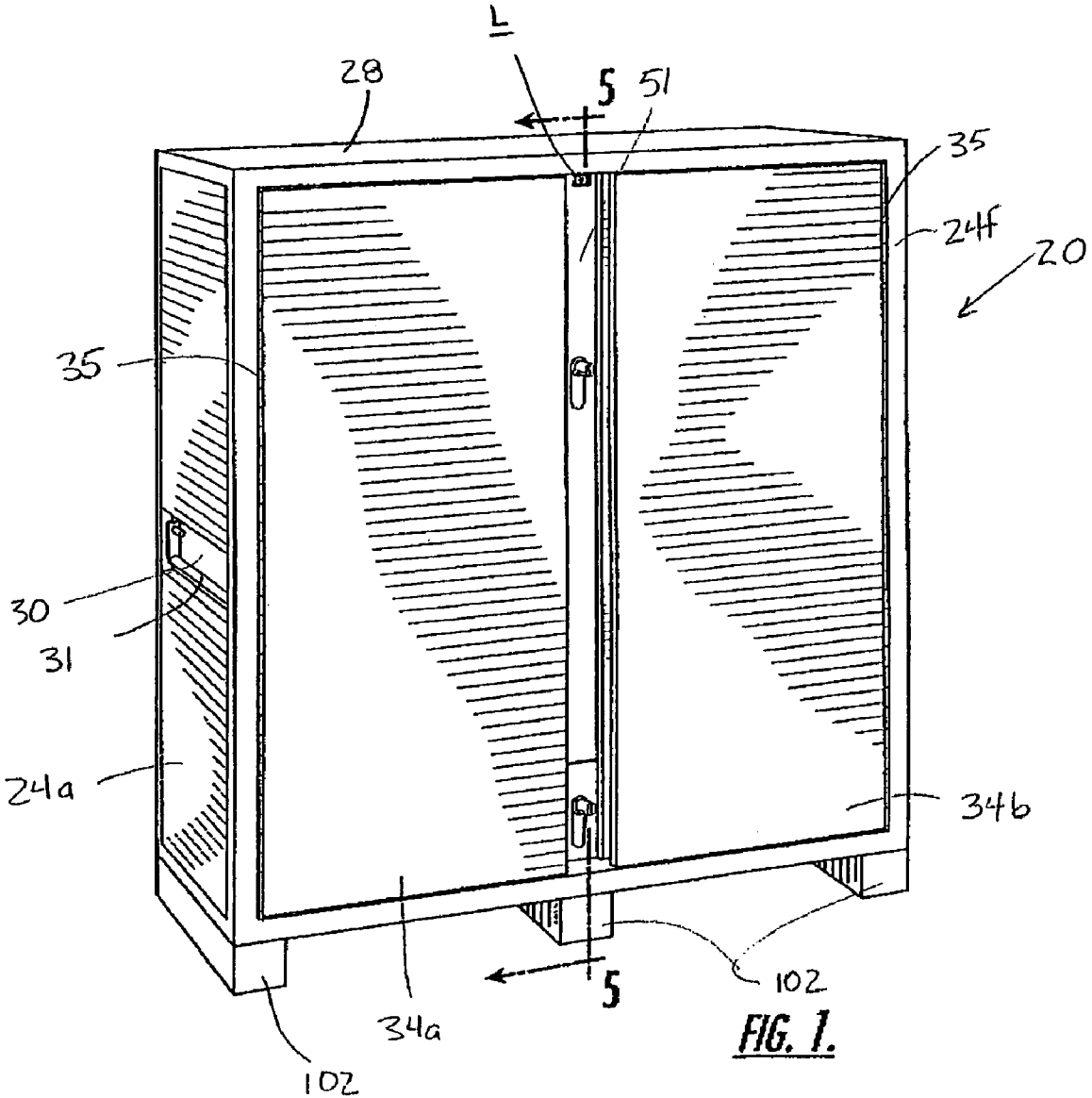
FIG. 1 is a perspective view of a storage cabinet of the present invention with the doors in the closed position, the latching mechanism in the latched position, and the padlock locked.

The present invention now will be described more fully hereinafter with reference to the accompanying drawings, in which preferred embodiments of the invention are shown and described. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like components throughout. Some layers, thicknesses, and other dimensions may be exaggerated for clarity.

Turning now to the drawings, a storage cabinet, designated broadly at 20, is illustrated in FIGS. 1-4. The cabinet 20 includes a generally horizontal floor 22 supported by three bolsters 102, two side walls 24*a*, 24*b* that rise vertically from opposite lateral edges of the floor 22, a rear wall 26 that rises vertically from the rear edge of the floor 22, and a ceiling 28 that extends horizontally between the top edges of the side walls 24*a*, 24*b* and the rear wall 26. The floor 22, sidewalls 24*a*, 24*b*, rear wall 26 and ceiling 28 define a storage cavity 29.

The floor 22, side walls 24*a*, 24*b*, rear wall 26 and ceiling 28 are formed of a single piece of sheet steel bent into the illustrated box-type shape; those skilled in this art will recognize that, although such unitary construction is preferred, the cabinet 20 of the present invention may be formed of multiple pieces of material. If sheet steel is employed, a sheet thickness of between about 12 and 22 guage is preferred.

Each of the side walls 24*a*, 24*b* includes a recess 30 within which a pivoting handle 31 is mounted; such recesses and handles are described in U.S. Pat. No. 4,288,134 to Weger, the disclosure of which is hereby incorporated herein by reference in its entirety. Three shelves 32 are mounted within the cabinet 20 to facilitate the storage of items therein (of course, the floor can also be used for storage).

The cabinet 20 further includes two doors 34*a*, 34*b*, each of which is pivotally interconnected with a front edge 24*f* of a respective sidewall 24*a*, 24*b* via a "piano hinge" type pivot 35. Each door 34*a*, 34*b* is pivotable between an open position (see FIG. 4) in which the cavity 29 is accessible from a position forward thereof, and a closed position (FIGS. 1 through 3), in which the door 34*a* confronts the front edges of the floor 22, side walls 24*a*, 24*b* and ceiling 28 and prevents forward access to the cavity 29 from a position forward thereof. The doors 34*a*, 34*b* are mirror images of each other about a vertical plane P that extends perpendicularly to the rear wall 26. As such, only the door 34*a* will be described herein, with the understanding that the discussion is equally applicable to the door 34*b*. It should also be understood that, when describing a component of the door 34*a* relative to the "front" or "rear" of the door 34*a*, these directions are the same as the front and rear directions of the cabinet 20 and refer to the orientation of the components of the door 34*a* when the door 34*a* is in the closed position shown in FIGS. 1 through 3.

The door 34*a* includes a front panel 36, side and handle panels 37, 38 that extend rearwardly from the front panel 36, and top and bottom panels 39*a*, 39*b*. Preferably, the front panel 36, the side and handle panels 37, 38, and the top and bottom panels 39*a*, 39*b* are formed of a single piece of sheet steel, but other configurations, including multi-piece configurations, may be suitable for use with this invention.

The handle panel 38 includes an elongate vertical recess 40 that serves as a handle for the door 34*a*; the configuration of the handle panel 38 and recess 40 is described in co-assigned and co-pending application Ser. No. 09/241,685, the disclosure of which is hereby incorporated herein by reference in its entirety. The handle panel 38, side panel 37, and top and bottom panels 39*a*, 39*b* are between about 2 and 8 inches in width, thereby providing the door 34*a* with a sufficient depth that the three shelves 42 of similar depth can be included for storage of small items (for example, spray paint cans).

Figure 4:
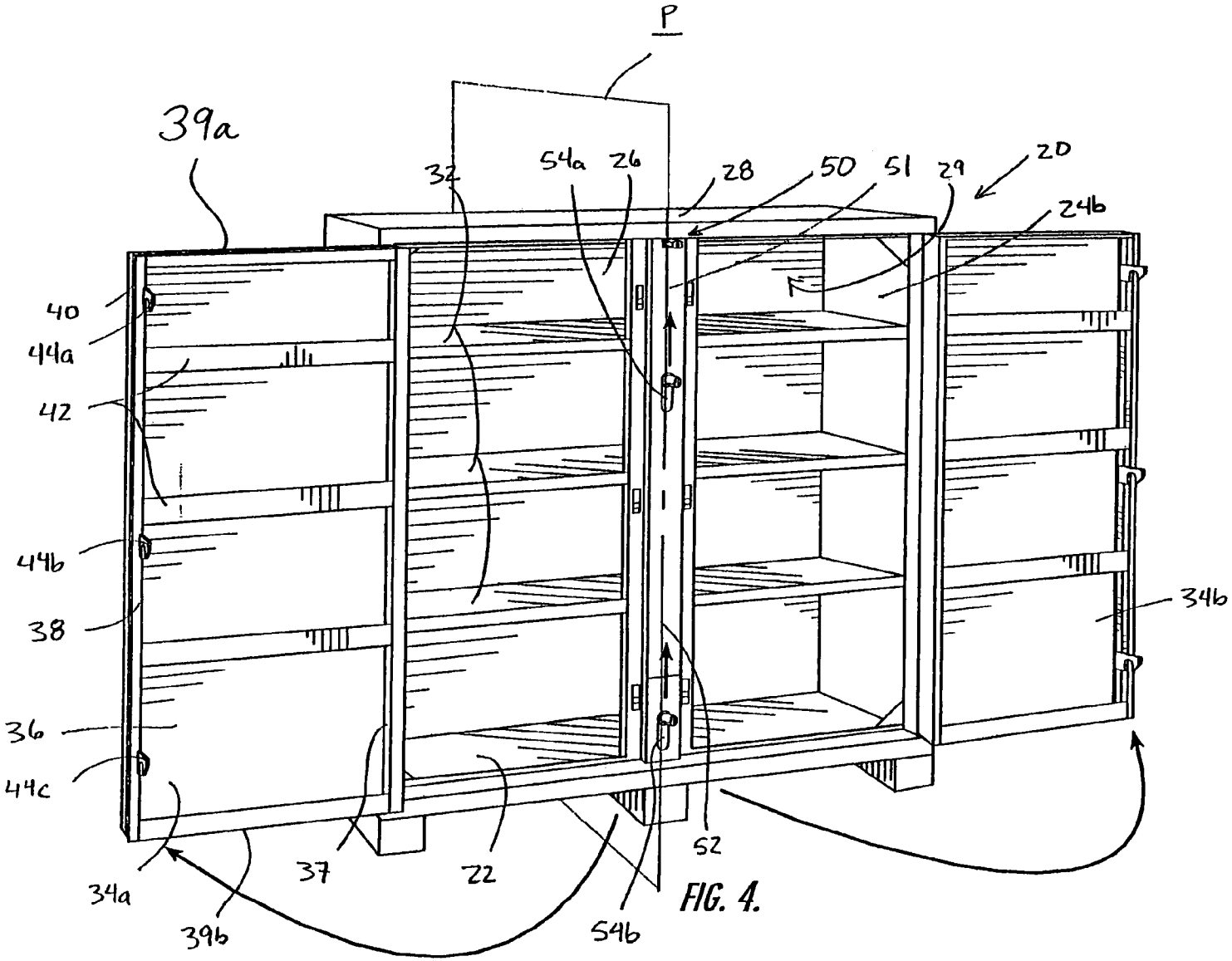
FIG. 4 is a perspective view of the storage cabinet of FIG. 1 with the doors in the open position and the latching mechanism in its latched position.
Figure 5:
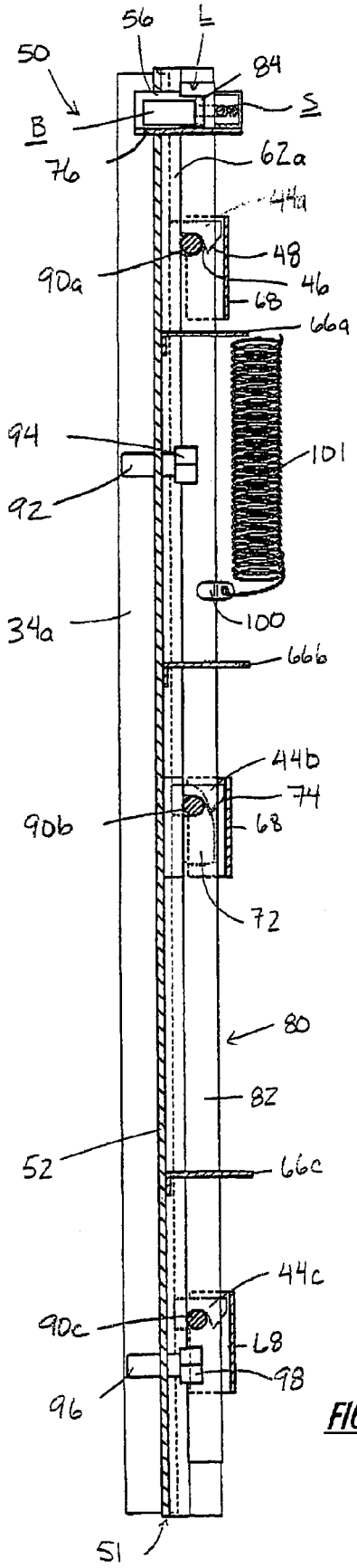
FIG. 5 is an enlarged partial side section view of the latching mechanism and support member of the storage cabinet of FIG. 1 taken along lines 5-5 thereof with the latching mechanism in its latched position.

Still referring to FIG. 4, the door 34*a* includes upper, middle and lower hooks 44*a*, 44*b*, 44*c* that are attached to the handle panel 38 and extend rearwardly therefrom when the door 34*a* is in its closed position. Each of these hooks 44*a*, 44*b*, 44*c* includes on its lower edge a cutout portion 46 and a ramped portion 48 located rearwardly of the cutout portion 46 (FIG. 5). The ramped portion 48 slopes upwardly from front to rear. Those skilled in this art will appreciate that other configurations and structures for engaging a pin, such as barbs, fingers, and the like, including those that may lack ramped portions, may also be suitable for use with the present invention.

Referring still to FIG. 4, and referring also to FIGS. 5-9, a support member assembly 50 extends vertically from a central portion of the front edge of the floor 22 to a central portion of the front edge of the ceiling 28. The support member assembly 50 includes a support member 51 having a front panel 52 that is sized such that, when the doors 34*a*, 34*b* are in their closed positions, the front panel 52 spans the gap between the handle panels 38 of the doors 34*a*, 34*b*; preferably, this gap is between about ½ and 10 inches. The front panel 52 includes upper and lower release member slots 54*a*, 54*b* that are oblong and generally vertically oriented, and also includes at its upper portion a rectangular, horizontally-oriented lock aperture 56.

Transitional sections 57*a*, 57*b* extend rearwardly from the front panel 52, and recessed sections 58*a*, 58*b* extend laterally from respective rear edges of the transitional sections 57*a*, 57*b*. Each recessed section 58*a*, 58*b* includes upper, middle and lower hook apertures 60*a*, 60*b*, 60*c* approximately equally spaced along the height of the recessed sections 58*a*, 58*b*. The support member 51 also includes side panels 62*a*, 62*b* that extend rearwardly from the lateral ledges of the recessed sections 58*a*, 58*b*. Each side panel 62*a*, 62*b* includes three shelf notches 64 that receive and support the front edges of the shelves 32 of the cabinet 20.

Preferably, the support member 51 is formed of a single piece of sheet steel having a thickness of between about 12 and 22 gauge, but those skilled in this art will recognize that other materials and configurations can be used to form the support member 51.

Referring again to FIGS. 5-9, the support member assembly 50 also includes upper, middle and lower carrier post guides 66*a*, 66*b*, 66*c* which are mounted to the rear surface of the front panel 52 in vertical alignment with one another. Each carrier post guide 66*a*, 66*b*, 66*c* includes an aperture 67; these apertures 67 are also vertically aligned with one another. Three U-shaped pin guards 68 are mounted to the lateral surfaces of the side panels 62 at a height that enables them to shield the hook apertures 60*a*, 60*b*, 60*c* from the rear. Two pin cam plates 70 are mounted to the inward surfaces of the transitional sections 57*a*, 57*b* at the height of the hook apertures 60*b* and extend rearwardly therefrom. Each pin cam plate 70 includes a tapered aperture 72 that has an inclined edge 74 such that the aperture 72 is narrower at its upper end then in its lower end.

A lock channel 76 sized to receive a padlock is mounted within the lock aperture 56 of the front panel 52. The lock channel 76 includes in its side walls an aperture 79 that is generally vertically aligned with the apertures 67 of the carrier post guides 66*a*, 66*b*, 66*c*. Shackle bolt holes 78 are included in each side wall of the lock channel 76. A shackle bracket 77 is mounted in the rear portion of the lock channel 76 and attached to the lock channel 76 via a bolt 76*b* inserted through the shackle bolt holes 78 and apertures 76*c* in the shackle bracket 77; two shackle apertures 81 are positioned in the side walls of the shackle bracket 77.

Referring still to FIGS. 5-9, a latching mechanism 80 is positioned rearwardly of the support member 51. The latching mechanism 80 includes an elongated, vertically disposed carrier post 82 that extends through the apertures 67 of the carrier post guide 66*a*, 66*b*, 66*c* and the aperture 78 of the lock channel 76. Mounting of the carrier post 82 within these apertures enables the carrier post 82 to slide vertically relative to the support member 51. The carrier post 82 includes several notches in its front edge: a lock notch 84 at its upper end at the level of the lock aperture 56; three pin notches 86*a*, 86*b*, 86*c* that are approximately equally spaced along the length of the carrier post 82 and located at the heights of respective hook apertures 60*a*, 60*b*, 60*c*; and two release member notches 88*a*, 88*b*, one of which is positioned between the pin notches 86*a* and 86*b* at the level of the upper release member slot 54*a*, and the other of which is positioned below pin notch 86*c* at the level of the lower release member slot 54*b*. Those skilled in this art will appreciate that configurations for a vertically slidable member other than the illustrated carrier post 82 may also be used with the present invention. For example, such a member may be formed of multiple pieces, take a shape that is nonlinear, include components for mounting pins that differ from the illlustrated configuration (such as the pins being welded directly to the member), and include a different locking structure (or lack one entirely).

The latching mechanism 80 also includes three horizontally disposed pins 90*a*, 90*b*, 90*c*, which are mounted within respective pin notches 86*a*, 86*b*, 86*c* on the carrier post 82; these pins extend laterally in both directions from the carrier post 82 and terminate adjacent the side panels 62 of the support member 51. An upper hand release member 92 is mounted within a nut 94, which is in turn mounted in the hand release member notch 88*a* of the carrier post 82. The hand release member 92 extends forwardly from the carrier post 82 through the upper release member slot 54*a* in the front panel 52. The hand release member 92 is preferably mounted at a height of between about 48 and 72 inches above the underlying surface to be convenient for operation by hand. Similarly, a lower foot release member 96 is mounted in a nut 98, which is in turn mounted in the lower lever notch 88*b;* the foot release member 96 extends forwardly through the foot release member slot 54*b*. The foot release member 96 is mounted at a height of between about 3 and 24 inches above the underlying surface to be convenient for operation with a foot. It is preferred that the hand and foot release members 92, 96 protrude from the support member 51 no further than the front panels 36 of the doors 34*a*, 34*b*. This configuration can eliminate any "appendage" from protruding forwardly beyond the doors 34*a*, 34*b* that can snag a person's clothing. A finger 100 is attached to the carrier post 82 just above the middle carrier post guide 66*b* and extends rearwardly therefrom.

A spring 101 is attached at its lower end to the finger 100 and extends upwardly to attach to a shelf 32; preferably, the spring 101 is in tension when so mounted, such that the carrier post 82 is biased upwardly. Those skilled in this art will recognize that the spring 101 can be mounted to other structures in the latching mechanism 80 and cabinet 20, can be a compression spring if mounted to a point below the finger 100, and can comprise another type of biasing unit such as an air cylinder. Also, if the hooks 44*a*, 44*b*, 44*c* or other pin-engaging structure were inverted, such that the cutout portions 46 face upwardly, the spring 101 may be mounted to bias the carrier post 82 downwardly.

Figure 10:
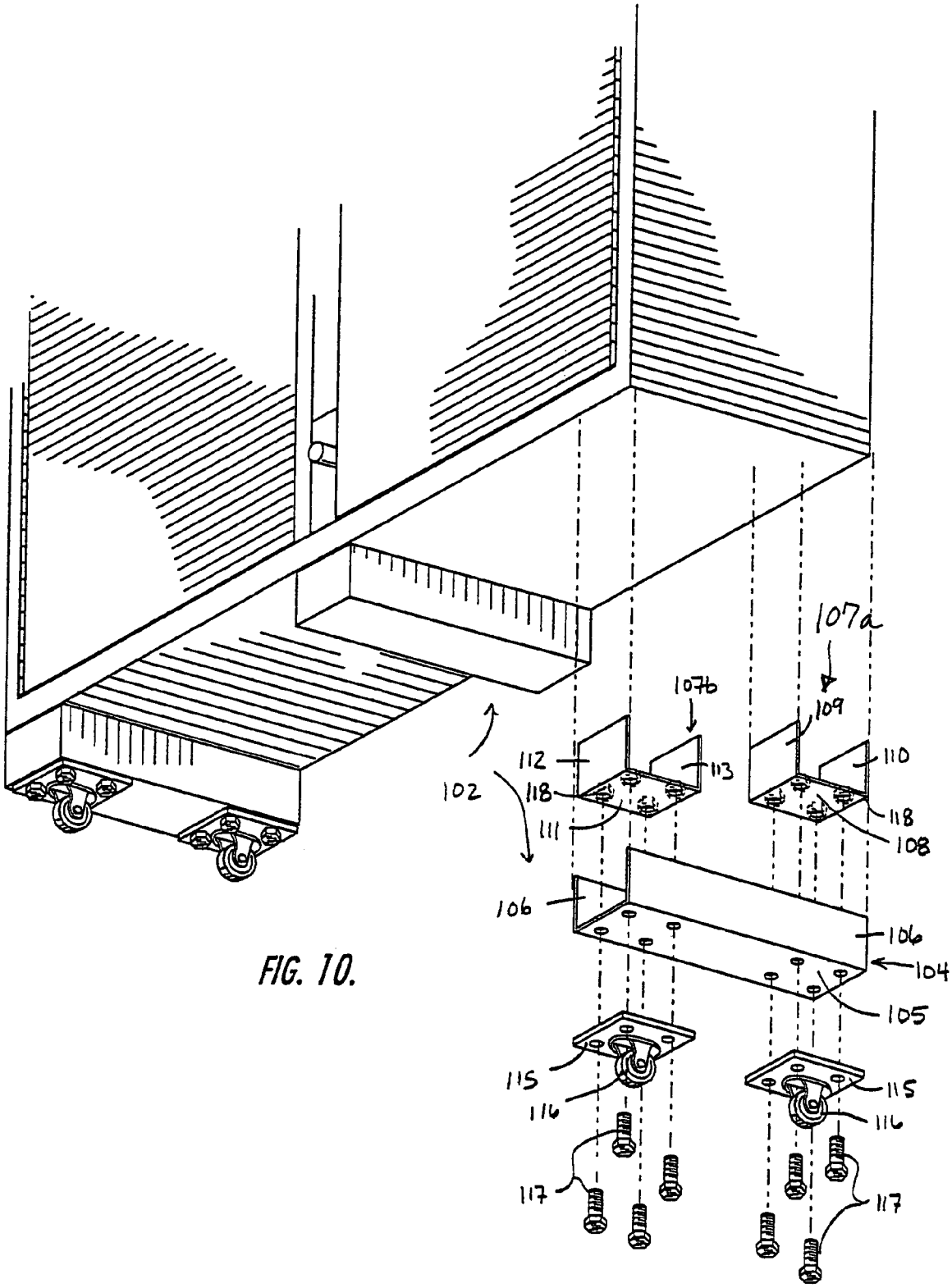
FIG. 10 is a bottom, partially exploded, perspective view of the floor, bolsters and casters of the storage cabinet of FIG. 1.

Turning now to FIG. 10, three identical bolsters 102 are mounted to the lower surface of the floor 22. As seen in FIG. 10, each bolster 102 includes a lower channel 104. The lower channel 104 includes a floor 105 and two side panels 106 extending upwardly therefrom. A rear bracket 107*a* includes a floor 108 that rests upon and is welded to the upper surface of the floor 105, a front panel 109 that extends upwardly from the front edge of the floor 108, and a rear panel 110 that extends upwardly from the rear edge of the floor 108. A front bracket 107*b* includes a floor 111 that rests on and is welded to the upper surface of the floor 105, a front panel 112 that extends upwardly from the edge of the floor 111, and a rear panel 113 that extends upwardly from the rear edge of the floor 111. The rear panel 109 of the rear bracket 107*a* is aligned with the rear edges of the side panels 106, and the front panel 112 of the front bracket 107*b* is aligned with the front edges of the side panels 106.

A castor plate 115, upon which is mounted a castor 116, is mounted to the underside of lower channel floor 105 below each front bracket 107*b* and each rear bracket 107*a*. The caster plates 115 are mounted via bolts 117, which extend through apertures in the floors 105, 108, 111 and into weld nuts 118 or other threaded fasteners mounted to the upper surfaces of the floors 108, 111.

When the cabinet 20 is in a latched and locked condition (FIGS. 1, 5 and 9), the doors 34*a*, 34*b* are in their closed positions (FIGS. 1 through 3), with the handle panels 38 facing each other. The carrier post 82, and in turn the upper, middle and lower pins 90*a*, 90*b*, 90*c*, are raised into a latched position; the latched position is maintained by the section of the spring 101, which urges the carrier post 82 upwardly until upward movement is restrained by contact between the middle pin 90*b* and the upper end of the pin cam plate apertures 72. The upper, middle and lower hooks 44*a*, 44*b*, 44*c* extend through, respectively, the hook apertures 60*a*, 60*b*, 60*c* and engage, respectively, the upper, middle and lower pins 90*a*, 90*b*, 90*c*. A padlock L rests on the lock channel 76. The body B of the locked padlock L resides in and engages the lock notch 84 of the carrier post 82, thereby preventing vertical movement of the carrier post 82. The shackle S of the padlock L extends through the shackle apertures 81 such that forward and rearward movement of the shackle S is constrained.

Figure 2:
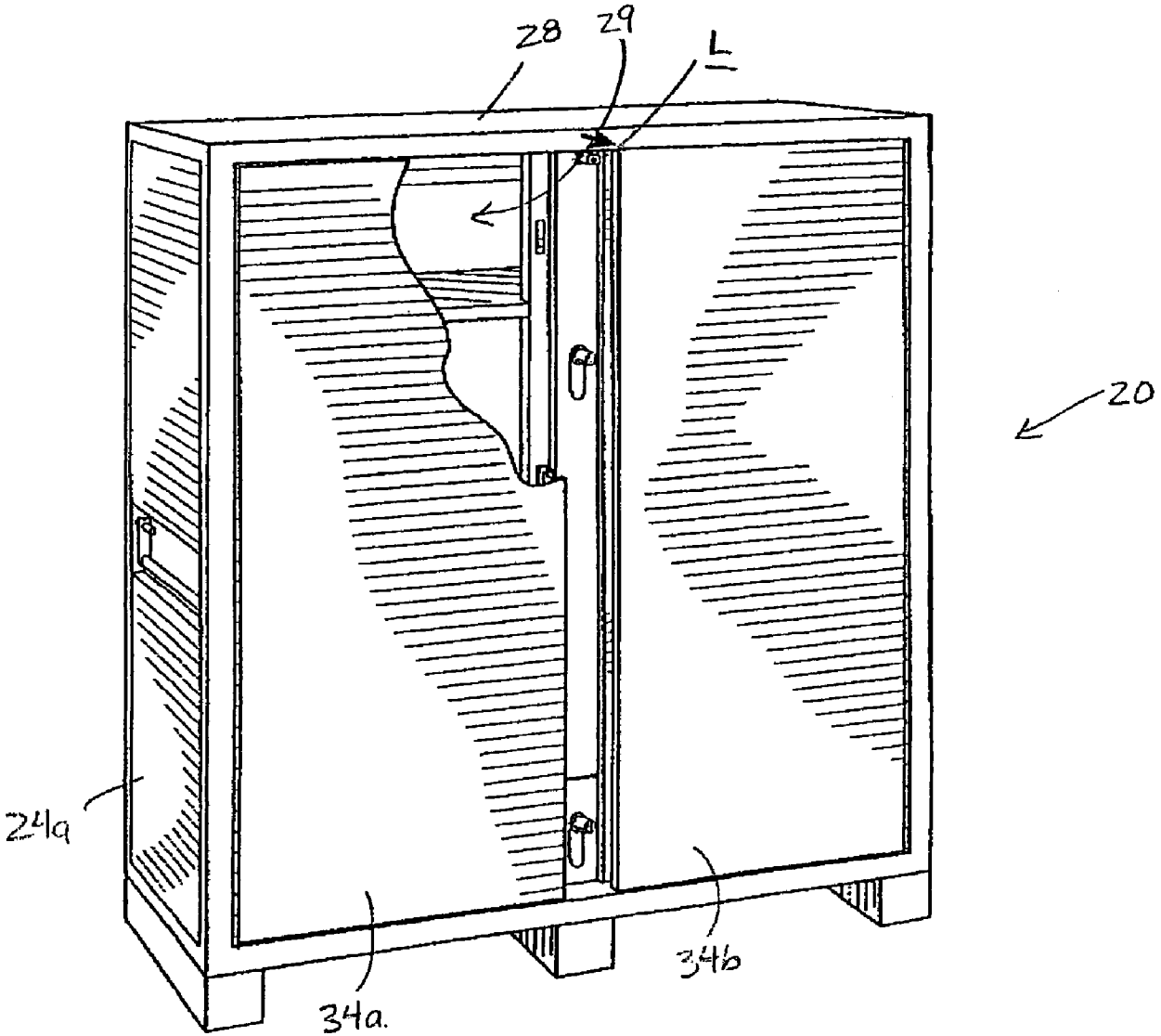
FIG. 2 is a cutaway perspective view of the storage cabinet of FIG. 1 with the latching mechanism in its latched position.
Figure 3:
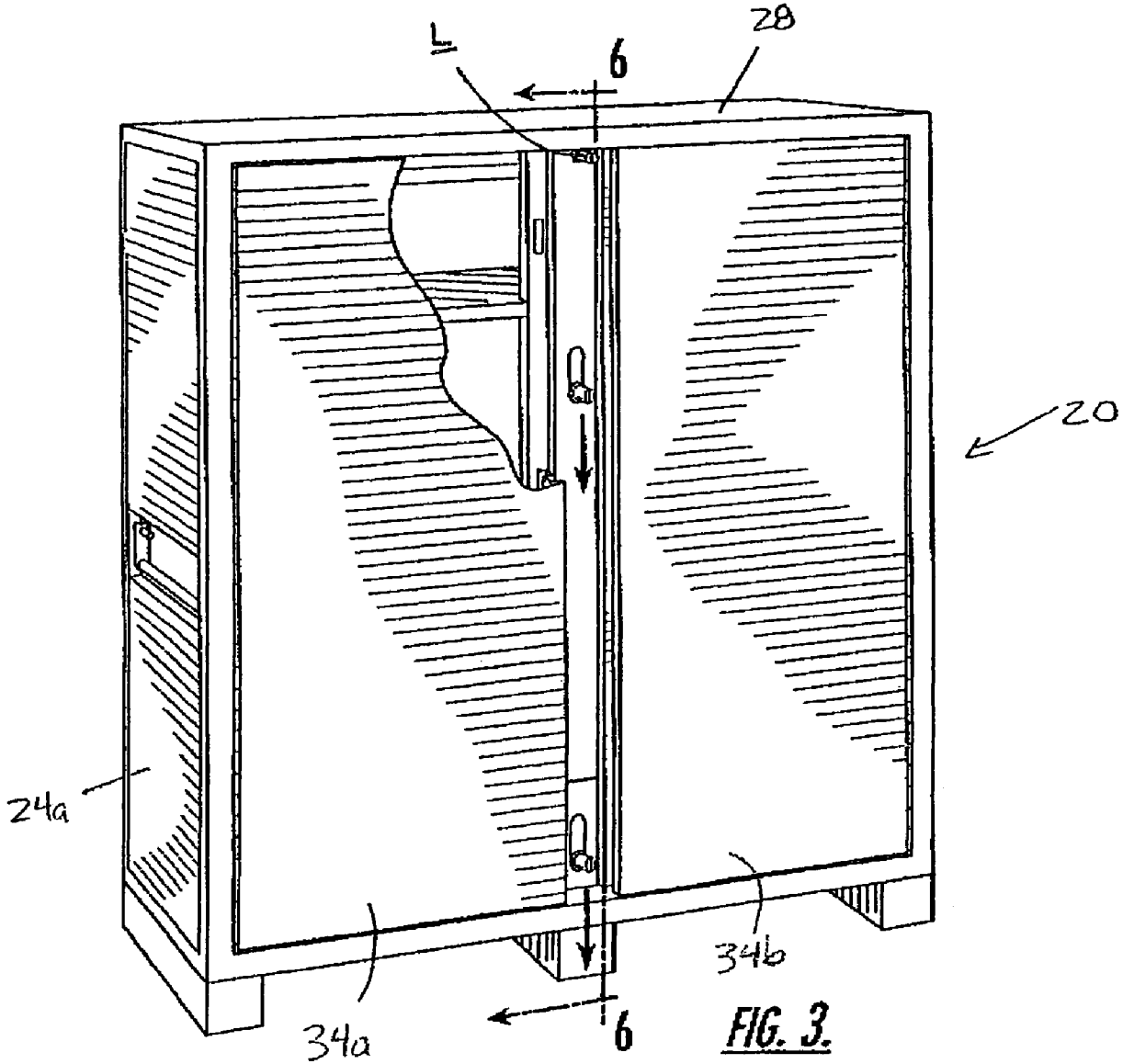
FIG. 3 is a cutaway perspective view of the storage cabinet of FIG. 1 with the latching mechanism in the unlatched position.
Figure 6:
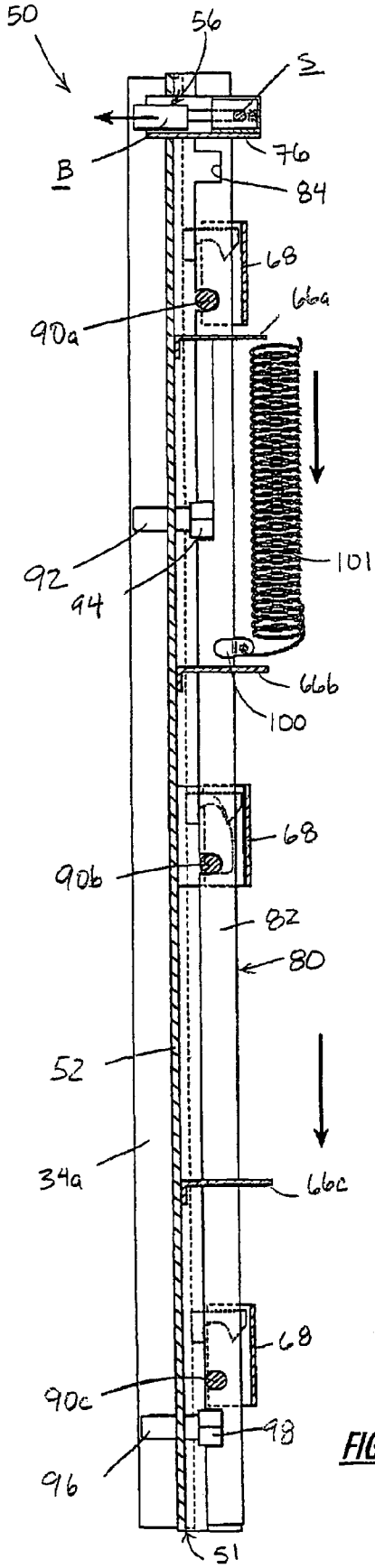
FIG. 6 is an enlarged partial side view of the support member and latching mechanism of FIG. 5 taken along lines 6-6 of FIG. 3 with the padlock unlocked and the latching mechanism in its unlatched position.
Figure 7:
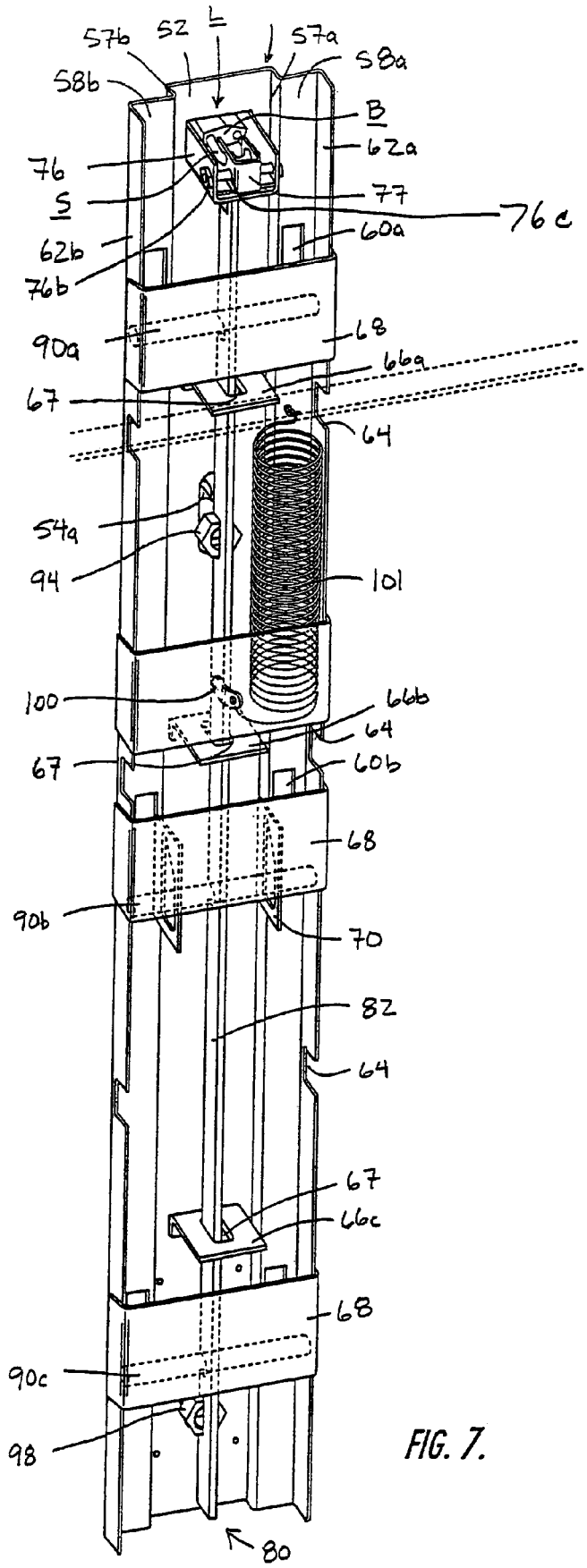
FIG. 7 is a rear perspective view of the support member and latching mechanism of FIG. 5 with the latching mechanism in its unlatched position.
Figure 8:
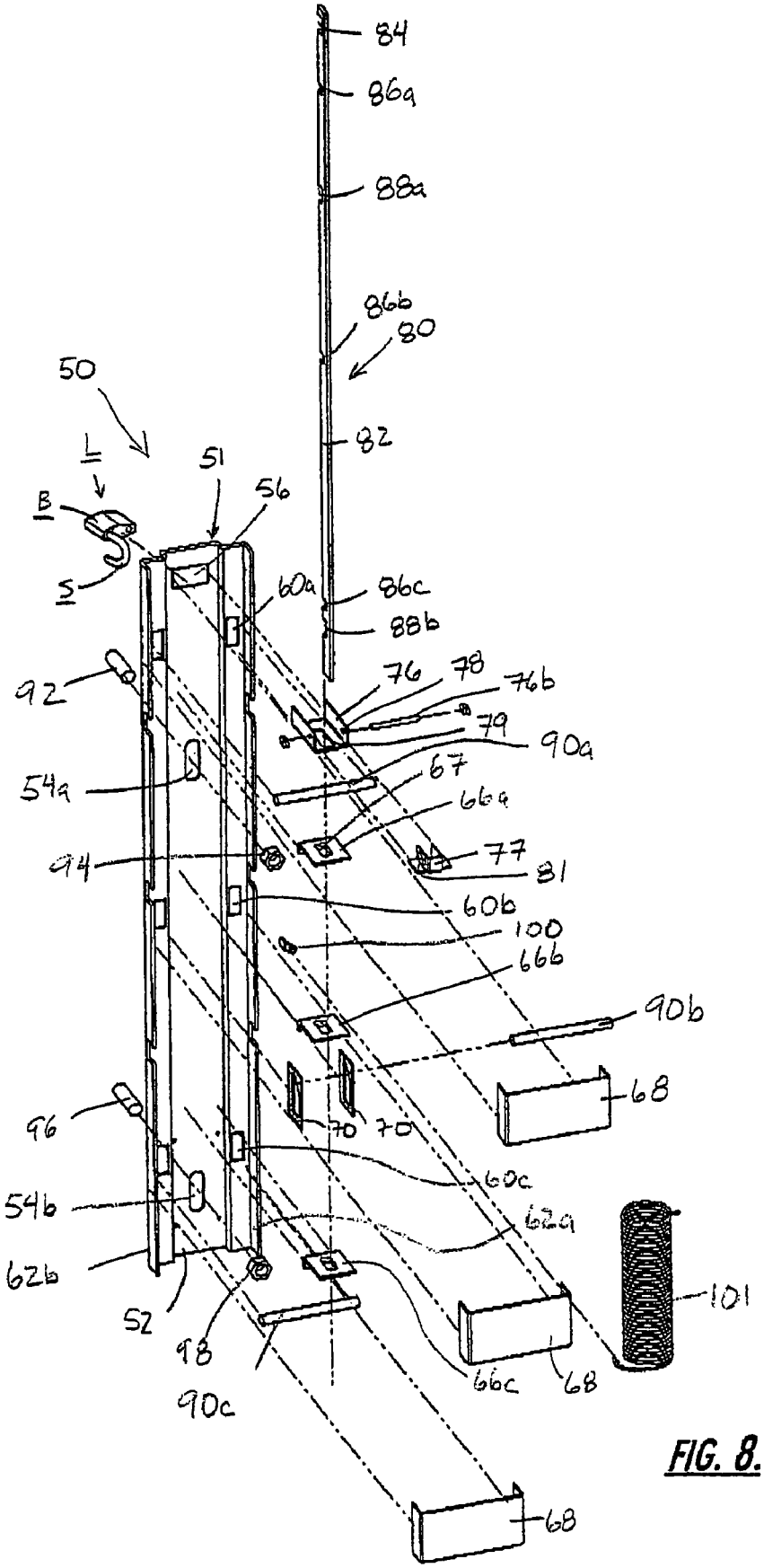
FIG. 8 is an exploded rear perspective view of the support member and latching mechanism of FIG. 5.
Figure 9:
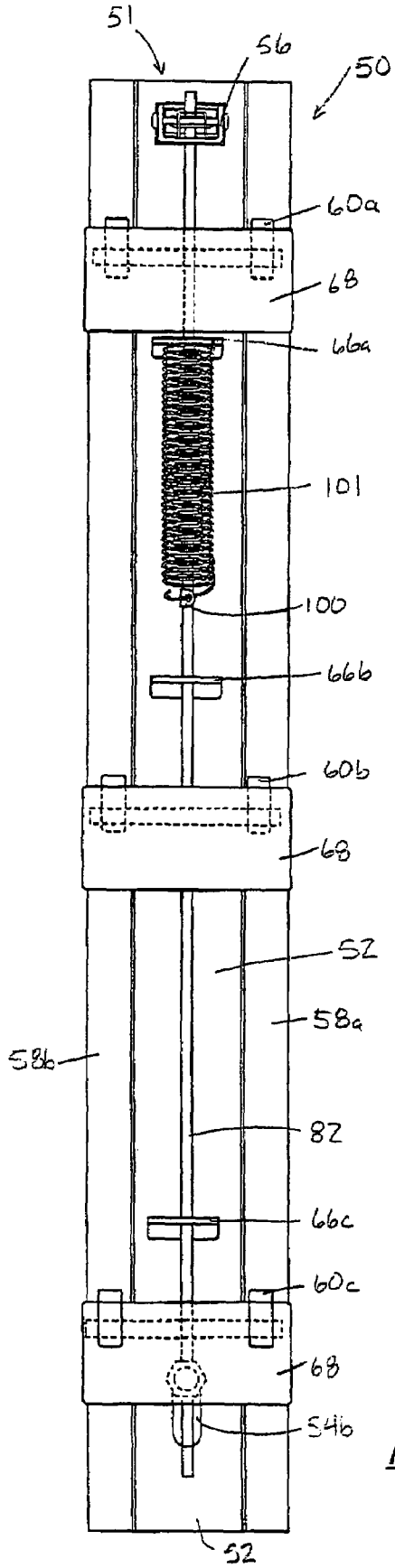
FIG. 9 is a rear view of the support member and latching mechanism of FIG. 5 with the latching mechanism in its latched position and the padlock in a locked condition.

When the padlock L is unlocked (typically with a key inserted into the key end thereof), the shackle S of the padlock L loosens relative to the body B, such that the body B is free to slide forwardly and disengage from the lock notch 84 (FIGS. 2, 6 and 7). This action frees the carrier post 82 for sliding vertical movement within the carrier post guides 66*a*, 66*b*, 66*c;* however, the upward biasing of the spring 101 on the carrier post 82 retains the doors 34*a*, 34*b* in their closed positions.

The doors 34*a*, 34*b* of the cabinet 20 can be opened by the application of a downwardly-directed force on either the hand release member 92 or the foot release member 96 (depending on which is more convenient for the operator). In either event, the force lowers the carrier post 82, and, in turn, the pins 90*a*, 90*b*, 90*c*, to an unlatched position in which the pins 90*a*, 90*b*, 90*c* disengage from the hooks 44*a*, 44*b*, 44*c* (see FIGS. 3 and 6). Once the hooks 44*a*, 44*b*, 44*c* are disengaged from the pins 90*a*, 90*b*, 90*c*, the doors 34*a*, 34*b* can be opened with a light horizontally- and forwardly-directed force on the handle panels 38 (FIG. 4). Once the hand release lever 92 and foot release lever 96 are released, they return (as do the pins 90*a*, 90*b*, 90*c*) to the latched position due to the upwardly-directed biasing force applied by the spring 101.

The doors 34*a*, 34*b* can be closed without actively operating the latching mechanism 34. As the doors 34*a*, 34*b* are moving to the closed position, the hooks 44*a*, 44*b*, 44*c* contact the pins 90*a*, 90*b*, 90*c*. The ramped portions 48 of the hooks 44*a*, 44*b*, 44*c* drive the pins 90*a*, 90*b*, 90*c* downwardly. Notably, the downward movement of the pins 90*a*, 90*b*, 90*c* is facilitated by the interaction between the middle pin 90*b* and the inclined edges 74 of the pin cam plates 70; in this configuration, the pins 90*a*, 90*b*, 90*c* are urged downwardly and rearwardly and are unlikely to stick in place due to contact with the hooks 44*a*, 44*b*, 44*c*. After the hooks 44*a*, 44*b*, 44*c* travel rearwardly a sufficient distance that the cut-out portion 46 of each hook is above its respective pin, the pins 90*a*, 90*b*, 90*c* rise in response to the biasing of the spring 101 to engage the hooks 44*a*, 44*b*, 44*c*, thereby latching the doors 34*a*, 34*b*. Again, this movement is facilitated by the inclined edges 74 of the pin cam plates, which urge the middle pin 90*b* (and, in turn, the upper and lower pins 90*a*, 90*c* and the carrier post 82) forwardly, with the result that a firm interaction between the pins 90*a*, 90*b*, 90*c* is achieved. The cabinet 20 can then be locked by pushing the body B of the lock L into the shackle S, which forces the body B into the lock notch 84 of the carrier post 82. The inclined edges 74 of the pin cam plates 70 also assist in keeping the carrier post positoned forwardly so that interaction between the body B and the lock notch 84 is snug.

As can be seen by the foregoing discussion, the storage cabinet of the present invention enables an operator to unlatch the cabinet through the use of either the hand release member 92 or the foot release member 96. As such, an operator approaching an unlocked, latched cabinet 20 with his hands full of items can still unlatch the doors 34*a*. 34*b* to access the cavity 29 of the storage cabinet 20.

Further, the biasing of the carrier post 82 toward the latched position enables an operator to close the doors 34*a*, 34*b* by simply pushing them closed rather than operating the latching mechanism 80. This configuration also increases the likelihood that a door that the operator wishes to remain closed will do so, as he need not actively move the latching mechanism to the latched position to maintain that door in a latched condition. The likelihood of a door opening undesirably increases with doors such as those illustrated herein that, because they include shelves that can be heavily loaded, may have sufficient weight to swing open without the operator applying a force thereto, so the configuration of the present invention can be quite advantageous for such cabinets.

Finally, the structure of the bolsters 102 provides additional strength and rigidity above the castor plates 115. As such, the likelihood of fracture associated with the mounting of the castor plates 115 can be reduced.

The foregoing is illustrative of the invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A storage cabinet comprising:

a container having a floor, upright side walls and a rear wall attached to and extending upwardly from said floor, and a ceiling attached to said side walls and rear wall, said floor, side walls, rear wall, and ceiling defining a storage cavity;

two doors, each pivotally attached to the cabinet on opposite sides thereof, and each movable about respective pivot axes located on opposite sides of the cabinet between an open position, in which said cavity is accessible from a position forward thereof, and a closed position, in which said doors prevent access to said cavity from a position forward thereof; and a latching mechanism fixedly mounted relative to the container, said latching mechanism including at least one release member protruding forwardly from the container, the at least one release member being movable from a latched position to an unlatched position;

wherein said doors may be transitioned from a latched condition, in which said latching mechanism latches said doors in the closed position in which the doors are in side-by-side relationship, to an unlatched condition, in which said latching mechanism allows said doors to move to the open position, by moving the at least one release member from its latched position to its unlatched position; and wherein the at least one release member is mounted between about 3 and 24 inches above a surface underlying the cabinet.

2. The cabinet defined in claim 1, wherein the at least one release member is two release members, and wherein the release members are coupled such that movement of one of the release members to the unlatched position moves the other release member to the unlatched position.

3. The cabinet defined in claim 1, wherein the at least one release member is two release members, and one of the release members is mounted between about 48 and 72 inches above a surface underlying the cabinet.

4. The cabinet defined in claim 3, wherein the at least one release member is two release members, and wherein the release members are coupled such that movement of one of the release members to the unlatched position moves the other release member to the unlatched position.

* * * * *

UNITED STATES PATENT AND TRADEMARK OFFICE

CERTIFICATE OF CORRECTION

PATENT NO. : 7,370,890 B2
APPLICATION NO. : 10/765404
DATED : May 13, 2008
INVENTOR(S) : Samsel It is certified that error appears in the above-identified patent and that said Letters Patent is hereby corrected as shown below:

On Title Page:
Please add Item 60: --Related U.S. Application Data
Continuation-in-part of application No. 09/707,660, filed on Nov. 7, 2000, now Pat. No. 6,681,604.--

Signed and Sealed this

Fifth Day of August, 2008

JON W. DUDAS
*Director of the United States Patent and Trademark Office*